US009947494B2

(12) United States Patent
Ku et al.

(10) Patent No.: US 9,947,494 B2
(45) Date of Patent: Apr. 17, 2018

(54) FLIP SWITCH TIMER DECORATOR SWITCH CLIP

(71) Applicant: Coleman Cable, LLC, Waukegan, IL (US)

(72) Inventors: Shiao-Tsun Ku, Waukegan, IL (US); Matthew Haws, Indianapolis, IN (US)

(73) Assignee: COLEMAN CABLE, LLC, Waukegan, IL (US)

( * ) Notice: Subject to any disclaimer, the term of this patent is extended or adjusted under 35 U.S.C. 154(b) by 142 days.

(21) Appl. No.: 14/636,819

(22) Filed: Mar. 3, 2015

(65) Prior Publication Data

US 2015/0255233 A1 Sep. 10, 2015

Related U.S. Application Data

(60) Provisional application No. 61/947,713, filed on Mar. 4, 2014.

(51) Int. Cl.

| | |
|---|---|
| ***H01H 43/00*** | (2006.01) |
| ***H01H 23/22*** | (2006.01) |
| ***H01H 43/02*** | (2006.01) |
| ***H01H 43/24*** | (2006.01) |
| *H01H 23/08* | (2006.01) |
| *G04F 3/06* | (2006.01) |

(52) U.S. Cl.

CPC ..... *H01H 23/22* (2013.01); *H01H 43/022* (2013.01); *H01H 43/24* (2013.01); *G04F 3/06* (2013.01); *H01H 23/08* (2013.01)

(58) Field of Classification Search

CPC ..... H01H 23/22; H01H 43/022; H01H 43/24; H01H 23/08; G04F 3/06

USPC ..... 200/33 B, 331, 33 R, 33 D, 38 E, 38 R, 200/330

See application file for complete search history.

(56) References Cited

U.S. PATENT DOCUMENTS

| | | | | |
|---|---|---|---|---|
| 5,306,957 | A * | 4/1994 | Ellingham | H01H 23/22 200/33 R |
| 5,806,665 | A * | 9/1998 | Houssian | H01H 23/148 200/330 |
| 7,244,900 | B1 * | 7/2007 | Gray, Jr. | H01H 3/26 200/331 |
| 7,544,906 | B2 | 6/2009 | Blakeman | |
| 8,084,700 | B1 * | 12/2011 | Massaro | H01H 3/26 200/38 R |

* cited by examiner

*Primary Examiner* — Edwin A. Leon
*Assistant Examiner* — Lheiren Mae A Caroc
(74) *Attorney, Agent, or Firm* — Patzik, Frank & Samotny Ltd.

(57) ABSTRACT

A clip member that attaches to the actuator of a flip switch timer for a toggle switch to allow the flip switch timer to actuate a decorator switch between on and off positions. The clip member may include a connector or fastener including a pair of arms having clips for engaging a slot on the actuator. A lever arm on the switch engages the raised end of a decorator switch when the actuator, and thus the clip member, are moved linearly within the flip switch timer.

15 Claims, 11 Drawing Sheets

FLIP SWITCH TIMER DECORATOR SWITCH CLIP

RELATED APPLICATION

The present application is based upon U.S. Provisional Patent Application Ser. No. 61/947,713, filed Mar. 4, 2014 to which priority is claimed under 35 U.S.C. § 120 and of which the entire specification is hereby expressly incorporated by reference.

FIELD OF THE INVENTION

This invention relates in general to devices that may be used in connection with electrical wall switches to selectively move the switch between on and off positions pursuant to designated time sequences.

BACKGROUND OF THE INVENTION

Wall light switches generally come in two styles: a toggle switch which includes a small narrow switch and a decorator switch having a larger taller, wider and flatter switch. While wall light switches may be manually operated, there is often a need or desire to utilize flip switch timers that may be placed over the wall switches to permit a user to input a specific time sequence for controlling activation of the switch. This allows a user to, among other things, move the switch to the off position at designated times to conserve energy or switch to the on position to turn on lights, televisions or other appliances when away to give the impression that people are home to deter burglaries.

While switch activation devices or flip switch timers currently exist, because of the vast differences between a relatively thin toggle switch that extends out from the wall and a flat wide decorator switch, prior switch activation devices were designed for use with either a toggle switch or a decorator switch. Accordingly, consumers could not use a single type of device with different lights or outlets that had a different type of switch and therefore had to buy multiple types of flip switch timers.

Therefore, there is a need to produce a flip switch timers that may be used with either a toggle switch or a decorator switch.

SUMMARY OF THE INVENTION

The present invention is an improvement over the prior wall switch or flip switch timer devices in the way that it allows the device to be utilized with either a toggle switch or a decorator switch. In particular, the actuator of the flip switch timer can engage and move a toggle switch, or a clip member may be attached to the actuator of the flip switch timer, wherein the clip member can engage the decorator switch to move it between on and off positions.

The flip switch timer includes two differently-configured back plates for accommodating either a toggle switch or a decorator switch, respectively. The back plate for the toggle switch includes a small rectangular slot centrally located therein that allows the toggle switch to fit within and extend therethrough when the plate is attached over a wall outlet. The back plate may be removable attached through a pair of arms on one end of the back plate that fit within slots on the back of the flip switch timer and a pair of cylindrical or male members that fit within corresponding cylindrical slots or female members on the back of the flip switch timer.

The back plate for the decorator switch may be removably attached in the same way, but includes a larger centrally located opening to accommodate a decorator switch. Holes in the back plate allow the back plate to be removably attached to an outlet or outlet plate on a wall. In order to use the flip switch timer with a decorator switch, a clip member having a base with a fastener and a lever arm extending laterally from the base may be attached to the back of the flip switch timer. The fastener may consist of a pair of arm members extending downwardly from the base with clip members on the end to engage the inside of the rectangularly shaped actuator. A block attached or located on the underside of the lever arm may be used to keep the lever arm in a vertical or desired position relative to the flip switch timer, decorator switch and wall. Alternately, the clip member may include a contact member (e.g., a wall or node) that extends upwardly from the top of the lever arm to engage the decorator switch. It is appreciated that the clip may be made from a wide variety of materials including, but not limited to polycarbonate or ABS plastic. Once the clip is in place, the flip switch timer may be attached to the decorator switch back plate that has been attached to the decorator switch outlet or plate. Pursuant to a desired time sequence entered into the flip switch timer, or by a manual override, the actuator will move, thereby moving the lever arm of the clip to engage one end of the decorator switch to move it between on and off positions.

It is therefore an object of the present invention to provide a new flip switch timer that may be used with either toggle switches or decorator switches.

Yet another object of the present invention is to provide a new flip switch timer decorator clip member that allows a flip switch timer for a toggle switch to be used with a decorator switch.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
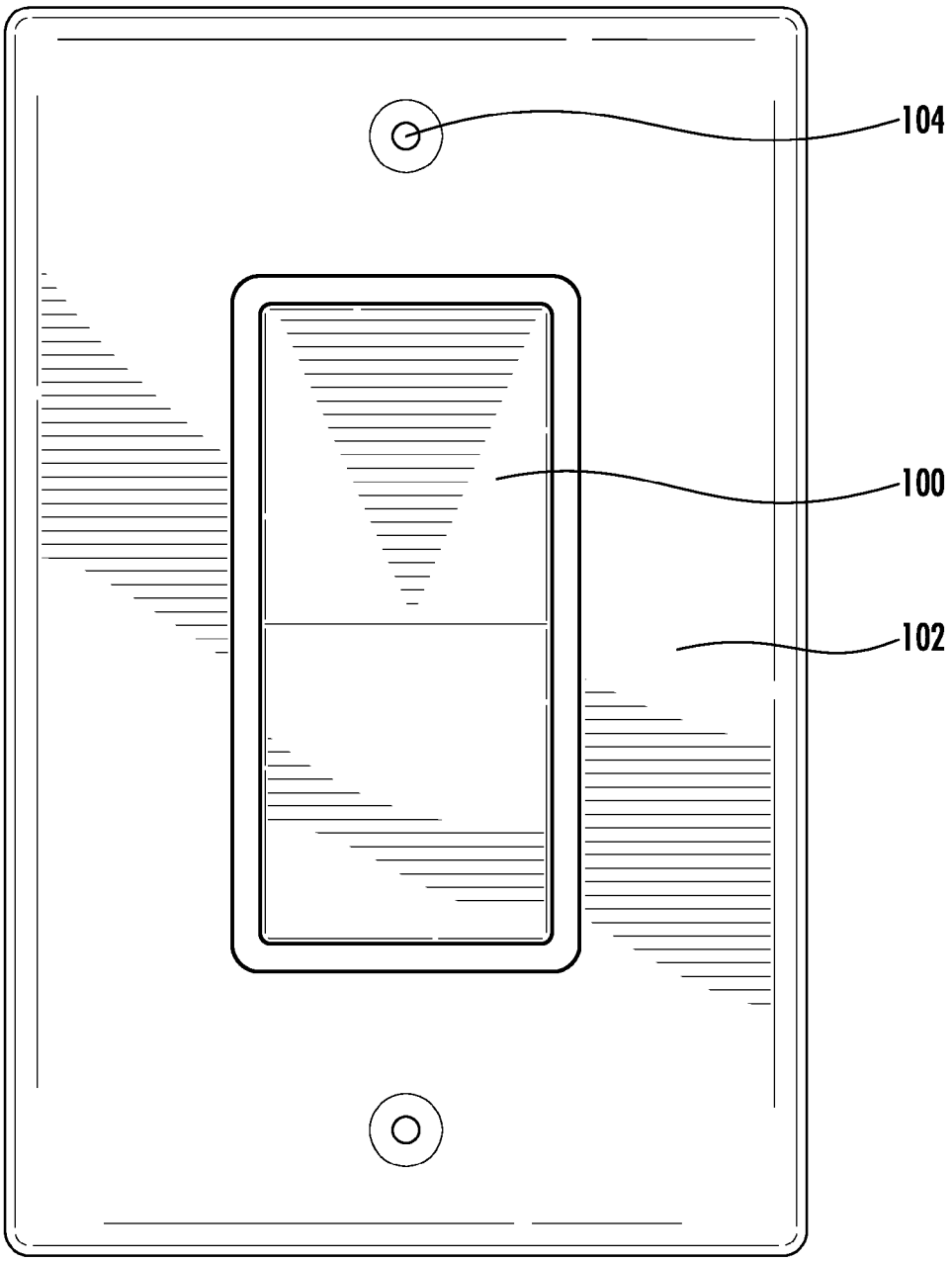
FIG. 1 is a front elevation view of a standard decorator switch and wall plate.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 14:
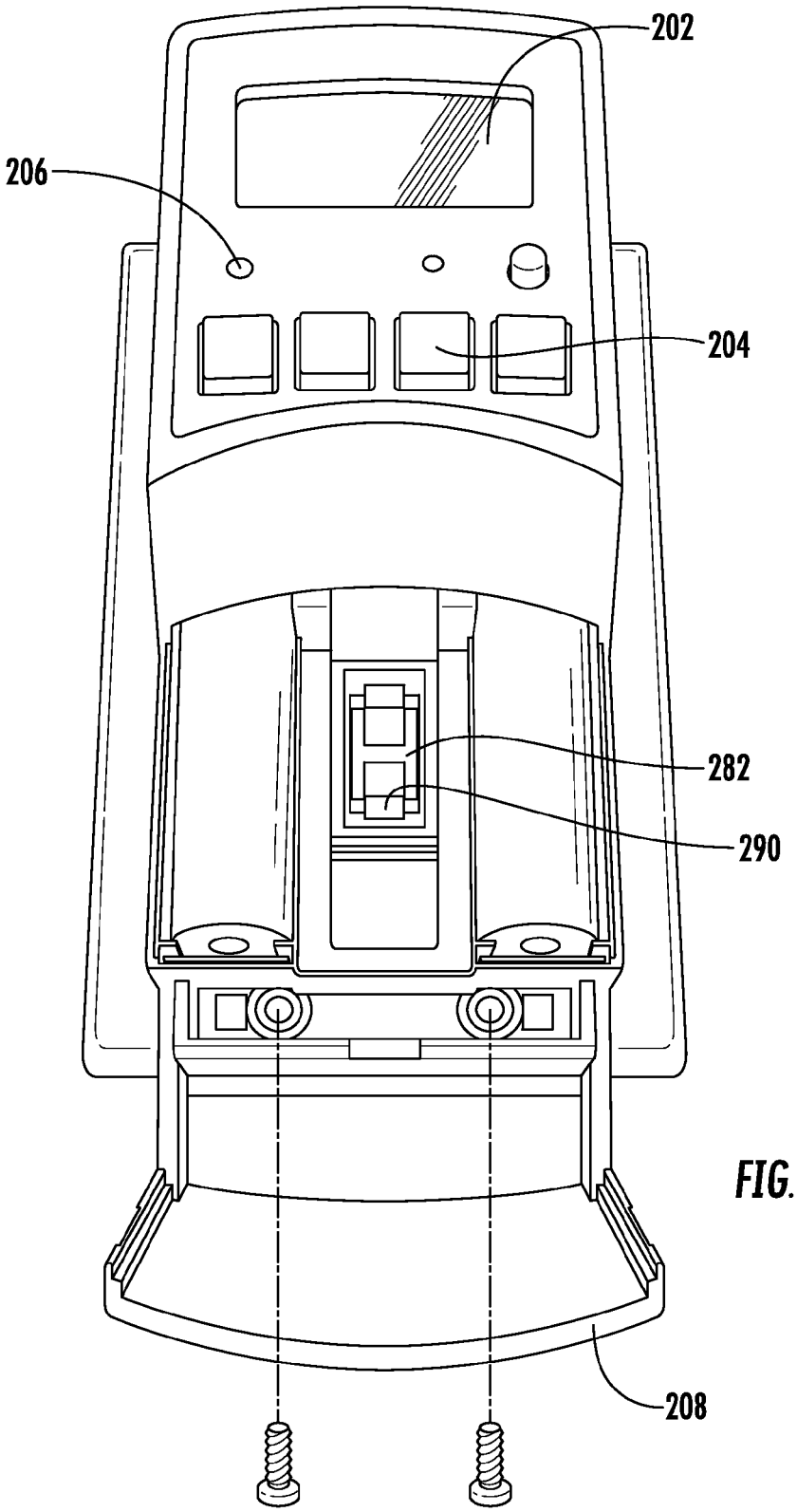
FIG. 14 is a front perspective view showing the clip member attached thereto and screws for attaching the flip switch timer to the decorator switch wall plate.
Figure 15:
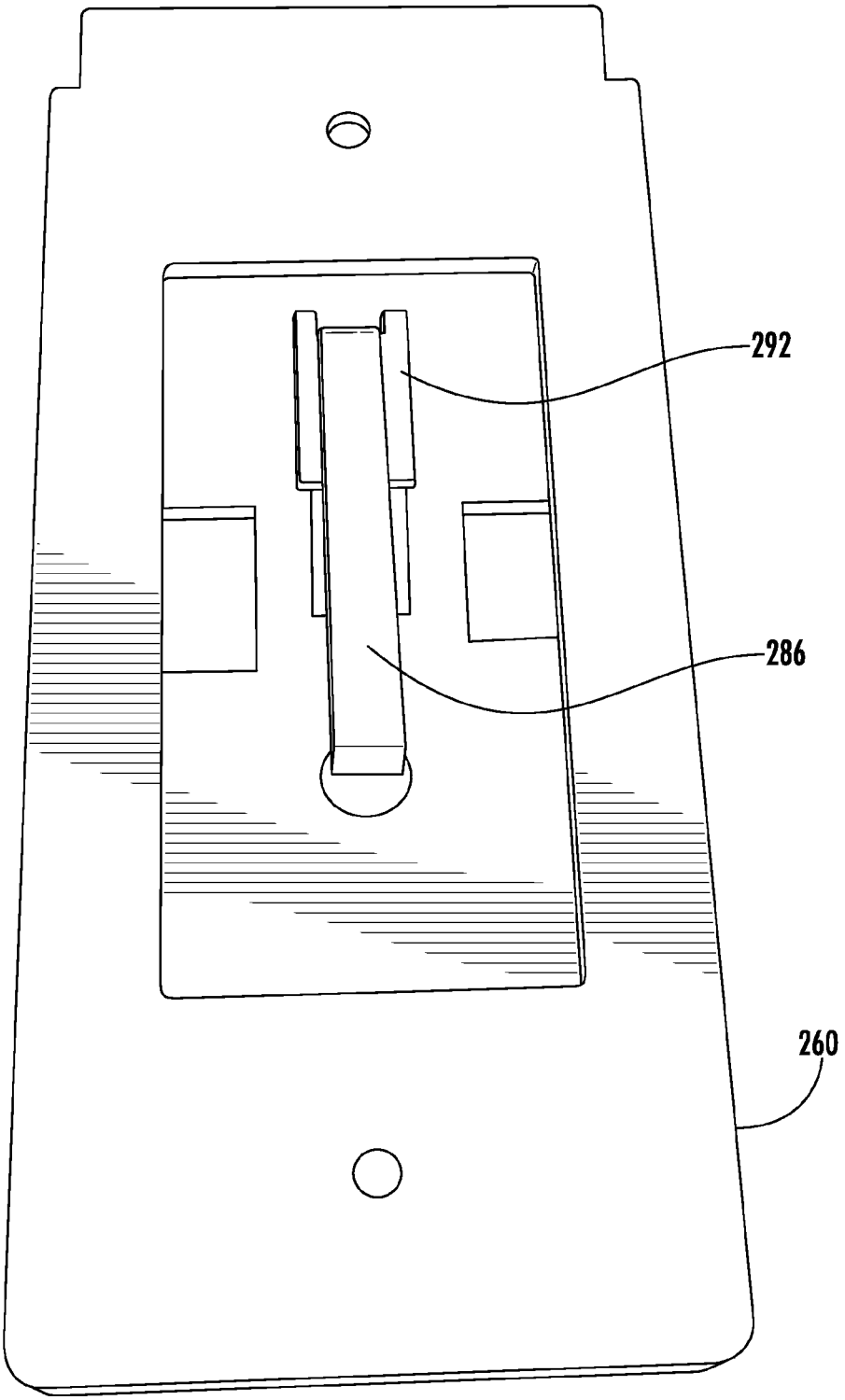
FIG. 15 is a rear perspective view showing a clip member attached to the flip switch mechanism and extending into the hole on the decorator switch back plate.

FIG. 1 illustrates a standard decorator switch 100 and associated decorator switch plate 102. Holes 104 may be located at the top and bottom of the plate 102 to permit the plate 102 to be connected to a decorator switch outlet using a pair of fasteners such as screws (see FIG. 14).

Figure 2:
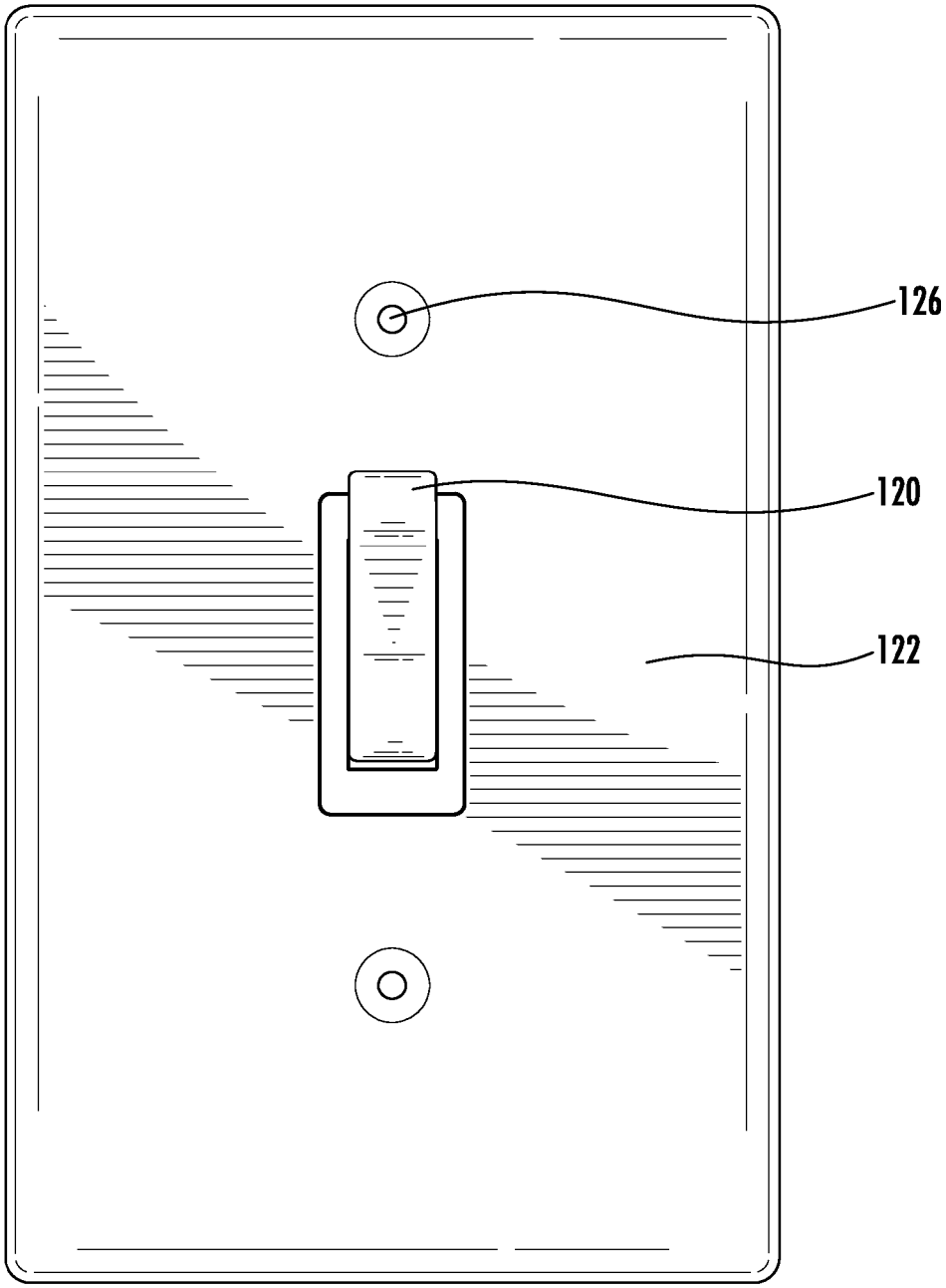
FIG. 2 is a front elevation view of a standard toggle switch and wall plate.

FIG. 2 depicts a standard toggle switch 120 and associated toggle switch plate 122. Holes 126 may be located at the top and bottom of plate 122 to permit the plate 122 to be connected to a toggle switch outlet using a pair of fasteners such as screws.

Figure 3:
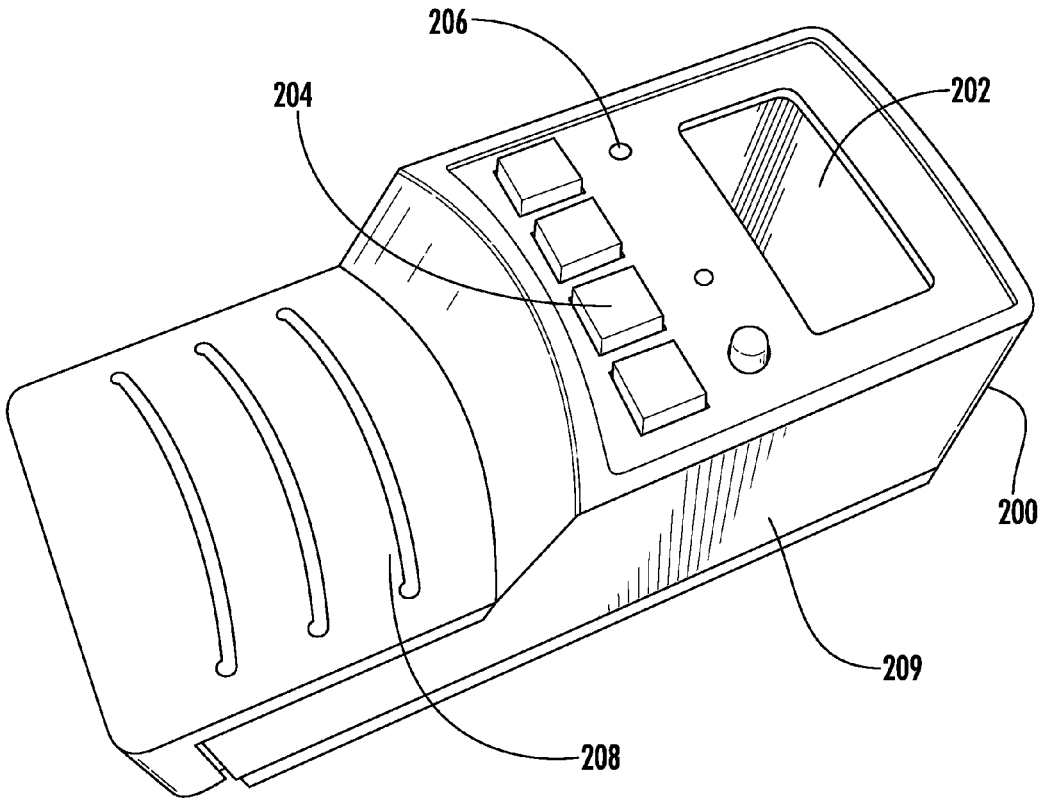
FIG. 3 is a front perspective view of a flip switch timer.

FIG. 3 depicts a flip switch timer 200 having a display screen 202, programmable buttons 204, battery or power indicators 206 and a panel 208 hingedly connected to the base 209 of the flip switch timer 200 to permit access to an internal battery compartment for storing batteries to provide power to the flip switch timer 200. The display screen 202 may be an LCD display or other known displays. Internal circuitry and memory allows a user to manually set a time sequence using programmable buttons 204 for actuating the respective switch for which the flip switch timer 200 is associated with. Power indicators 206 may be used to display when power is being supplied to the flip switch timer or the level of power left in the batteries to provide notice when the batteries should be replaced. The flip switch timer 200 may also permit a user to manually actuate the switch 100, 120 when desired by pressing an actuator such as a button 204 or other known actuating means.

Figure 4:
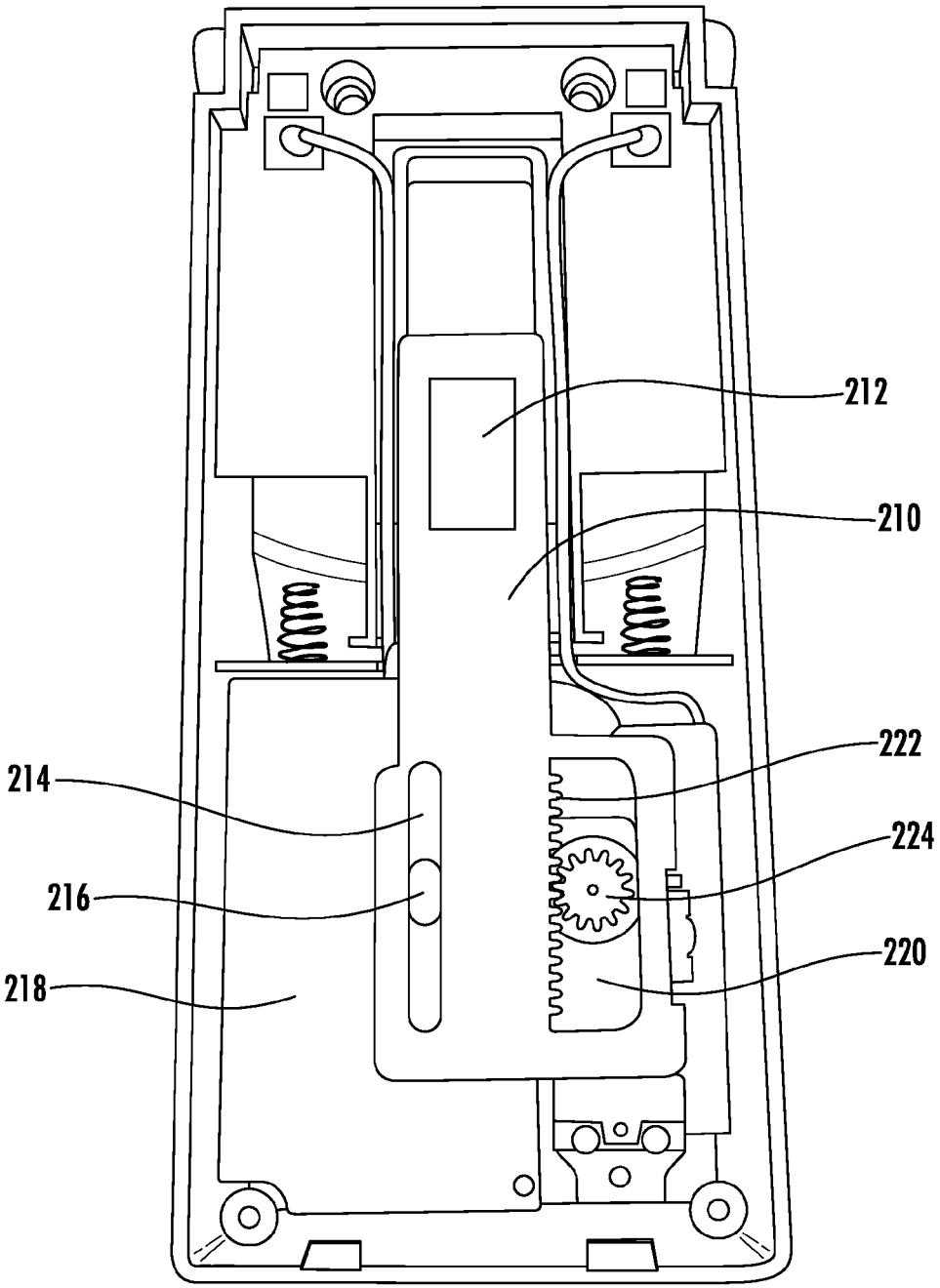
FIG. 4 is a rear perspective view of the flip switch timer of FIG. 3 without a back plate, showing internal components.
Figure 5:
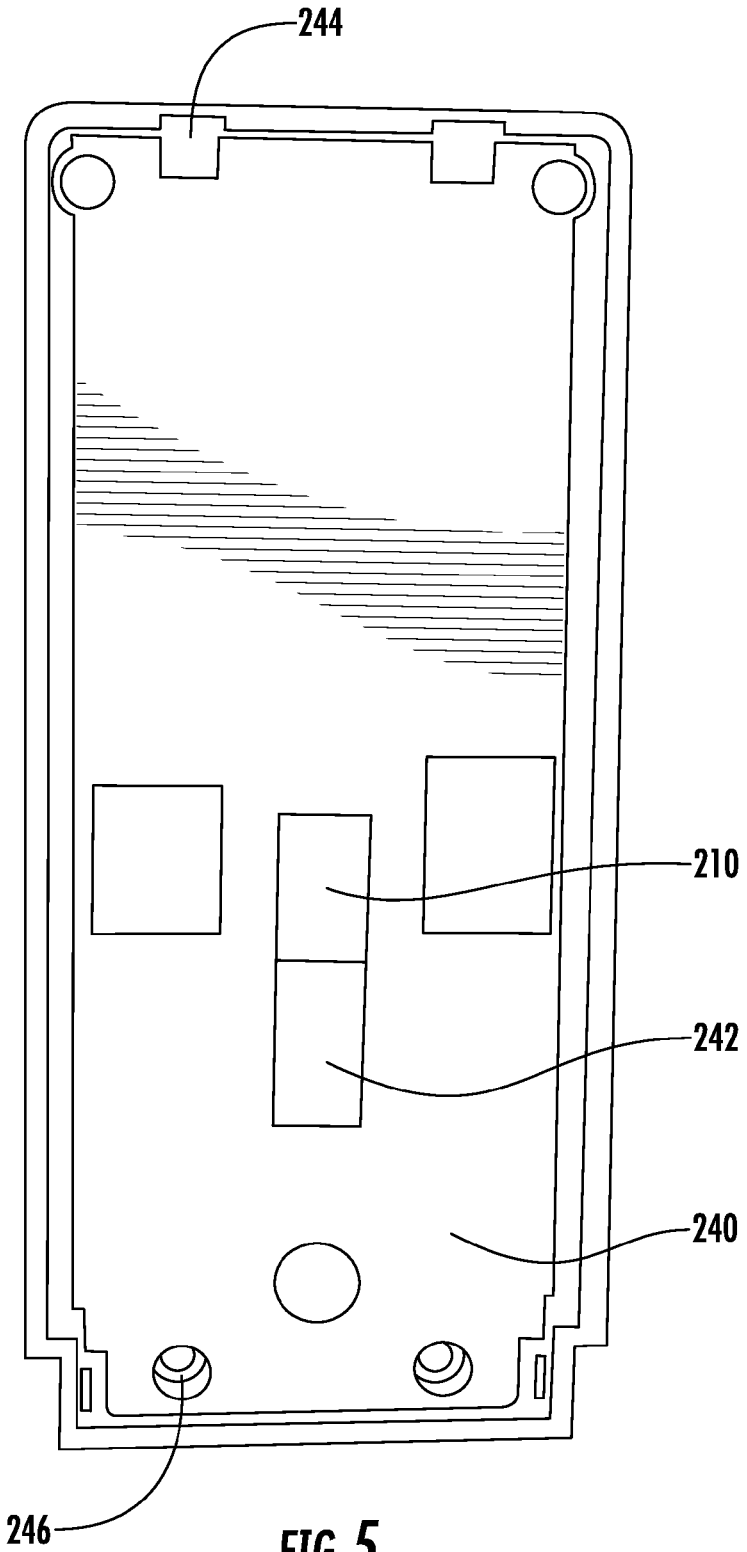
FIG. 5 is a rear elevation view of the flip switch timer of FIG. 3 showing a slot for receiving a clip member.

Referring to FIG. 4, the flip switch timer 200 includes an actuator 210 that includes a rectangular slot 212 proximate one end for engaging a toggle switch 120. The actuator 210 may include a slot 214 that slides relative to node 216 associated with or attached to internal wall 218 that permits the actuator 210 to move linearly to bias the toggle switch 120 between on and off positions. Another slot 220 may include teeth 222 on one side for engaging a corresponding toothed cam 224. When activated, a motor (not shown) drives the cam 224 to rotate, which engages the teeth 222 on the actuator 210 to move the actuator 210 linearly. Referring to FIG. 5, the flip switch timer 200 may include a back wall 240 that may be attached to the flip switch timer 200 using screws or other fasteners.

While a particular flip switch timer is shown and disclosed, it is appreciated that the clip of the present invention may work with other known flip switch timers for toggle switches including, but not limited to, the switch actuation device shown in U.S. Pat. No. 7,544,906 to Blakeman, the entirety of which is hereby incorporated by reference.

Figure 6A:
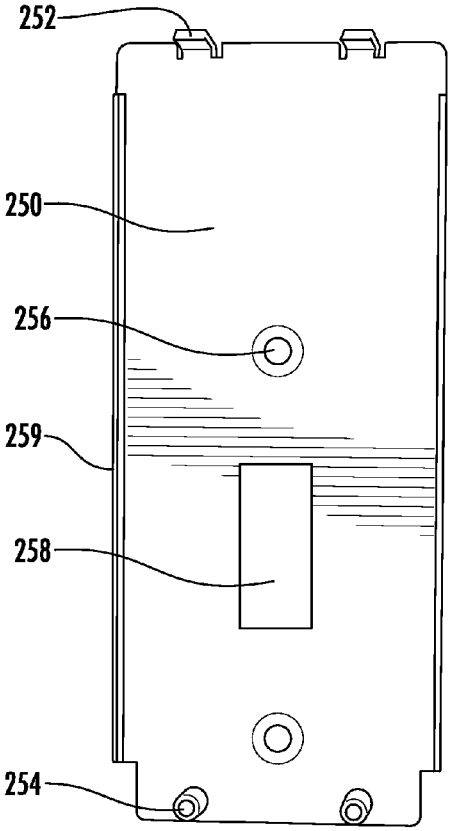
FIGS. 6*a* and 6*b* are rear elevation views showing back plates for a decorator switch and a toggle switch.
Figure 6B:
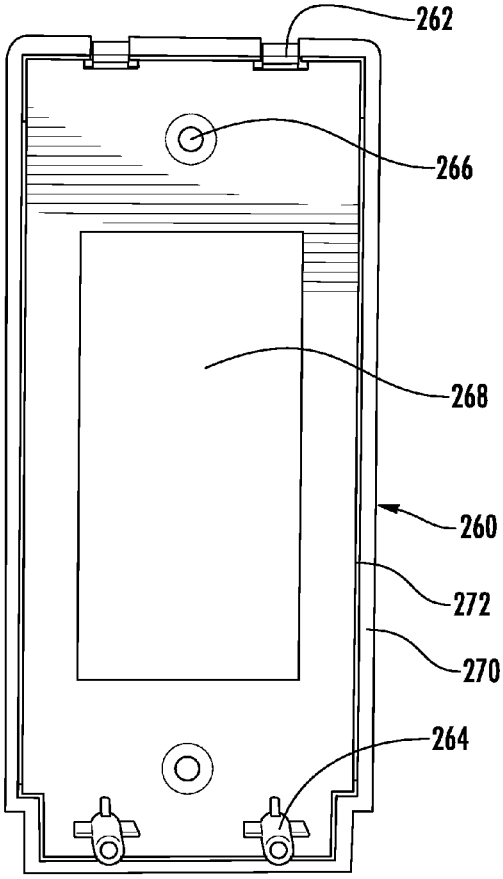

Referring to FIGS. 6A and 6B, the flip switch timer 200 may be used with either a toggle switch back plate 250 or a decorator switch back plate 260. The toggle switch back plate 250 includes a pair of arm members 252 at or proximate one end of the back plate 250 and a pair of cylindrical nodes or other male members 254 at or proximate the other end that engage corresponding holes, slots or female members 244, 246 on the back wall 240 of the flip switch timer 200, as shown in FIG. 5. While the arm members 252 are shown as rectangular in cross section and the male members 254 are shown as circular in cross section, it is appreciated that the may be a variety of shapes and not depart from the scope of the present invention. It is further appreciated that the back plate 250 may be attached to the flip switch timer 200 using other known means and not depart from the scope of the present invention. A pair of holes 256 on the back plate 250 are spaced apart to align with holes 126 in the toggle switch outlet or wall plate 122 so that the back plate 250 may be attached thereto using screws or other fasteners. A rectangular slot 258 is positioned in the back plate 250 to accommodate the toggle switch 120 to allow it to fit within and extend therethrough, while permitting the toggle switch 120 to move between on and off positions when the back plate 250 is attached to the toggle switch outlet or plate 122. Walls 259 may extend along the side of the back plate 250 to fit within the corresponding gap between the back wall 240 and the side of timer 200.

Similarly, the decorator switch back plate 260 includes a pair of arm members 262 at or proximate one end of the back plate 260 and a pair of cylindrical nodes or other male members 264 at or proximate the other end that engage corresponding holes, slots or other female members 244, 246 on the back of the flip switch timer 200, as shown in FIG. 5. While the arm members 262 are shown as rectangular in cross section and the male members 264 are shown as circular in cross section, it is appreciated that the may be a variety of shapes and not depart from the scope of the present invention. It is further appreciated that the plate 260 may be attached to the flip switch timer 200 using other known means and not depart from the scope of the present invention. A pair of holes 266 on the back plate 260 are spaced apart to align with holes 104 in the decorator switch outlet or wall plate 102 so that the back plate 260 may be attached thereto using screws or other fasteners. A rectangular slot 268 is positioned in the back plate 260 to accommodate the decorator switch 100 to allow it to fit within and extend therethrough, while permitting the decorator switch 100 to move between on and off positions when the back plate 260 is attached to the decorator switch outlet or plate 102. A raised wall 270 may extend around the perimeter of the back plate 260 to provide depth to the plate 260. Internal wall 272 may extend along the side of the back plate 260 to fit within the corresponding gap between back wall 240 and the side of timer 200.

Figure 7:
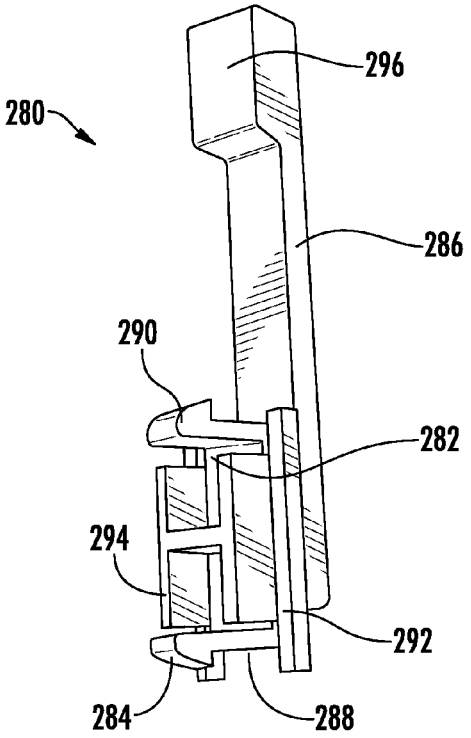
FIG. 7 is a perspective view of a first embodiment of a clip member of the present invention.
Figure 8:
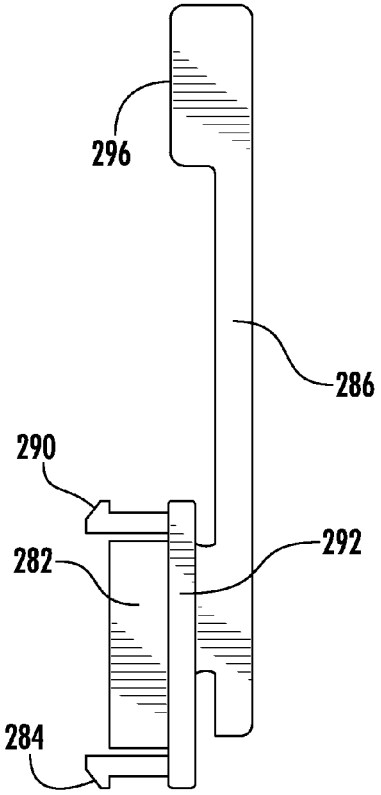
FIG. 8 is a side elevation view of the clip member of FIG. 7.

Referring now to FIG. 7, one embodiment of the clip member 280 of the present invention is shown and disclosed. The clip member 280 generally includes a base 282 having a fastener or connector 284 extending downwardly therefrom and a lever arm 286 extending longitudinally from about the base 282. The fastener 284 is shown as comprising a pair of arms 288 having clips 290 on their respective ends for engaging the walls about the slot 212 of the actuator 210. The arms 288 are preferably resilient to allow them to be pushed through the slot 212 and then return back to engage the back wall of the actuator 210 once the clips 290 pass through the slot 212. The base 282 may include a pair of runners or rail members 292 extending outward from the base 282 for providing a smooth contact surface to allow the clip member 280 to move readily over the back of back wall 240 about slot 242. Reinforcing member 294 may be located about the base 282 to provide rigidity and strength to the base 282.

Lever arm 286 extends outward from about the base 282 a sufficient distance to allow lever arm 286 to engage the surface of the decorator switch 100 to bias it between on and off positions. A block, wall or other object 296 may extend downward proximate the end of the lever arm 286 to retain the lever arm 286 in a vertical, or other desired, position when fastened to the flip switch timer 200. The clip member 280 may be made out of variety of known materials including, but not limited to, polycarbonate or ABS plastic.

Figure 9:
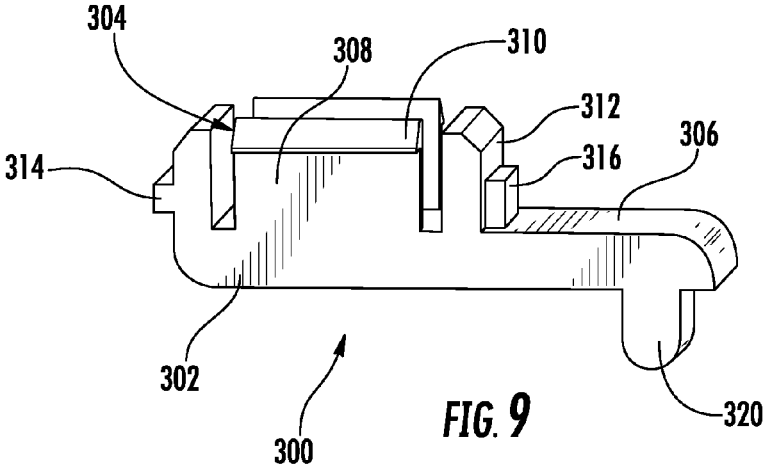
FIG. 9 is a perspective view of a second embodiment of a clip member of the present invention.
Figure 10:
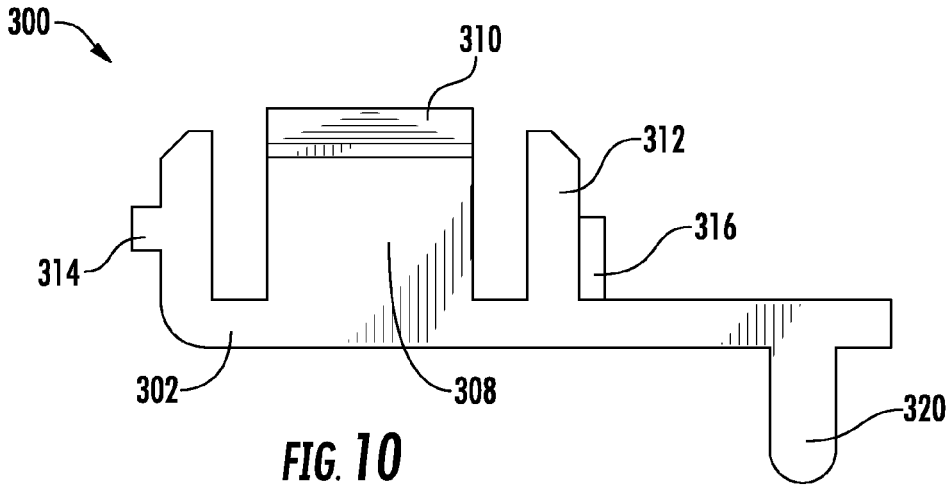
FIG. 10 is a side elevation view of the clip member of FIG. 9.
Figure 11:
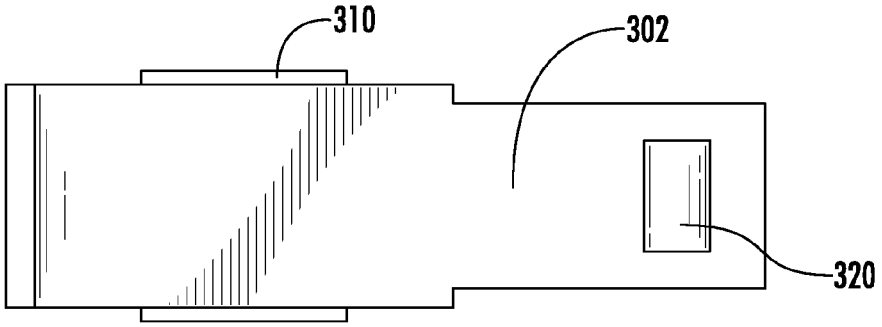
FIG. 11 is a bottom plan view of the clip member of FIG. 9.
Figure 12:
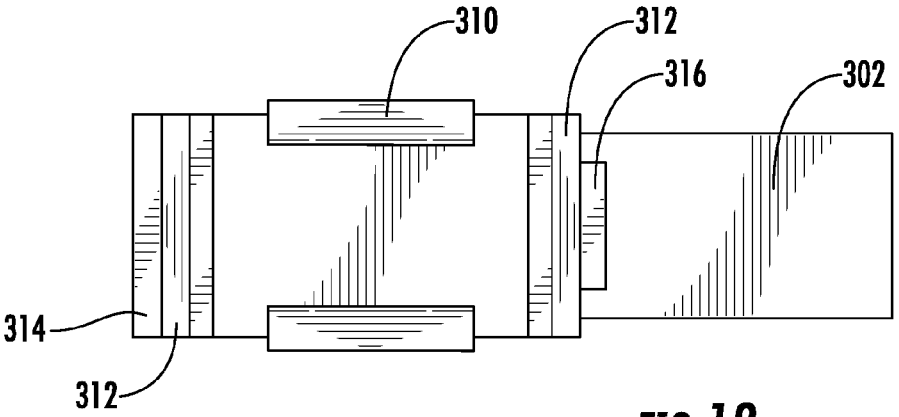
FIG. 12 is a top plan view of the clip member of FIG. 9.
Figure 13:
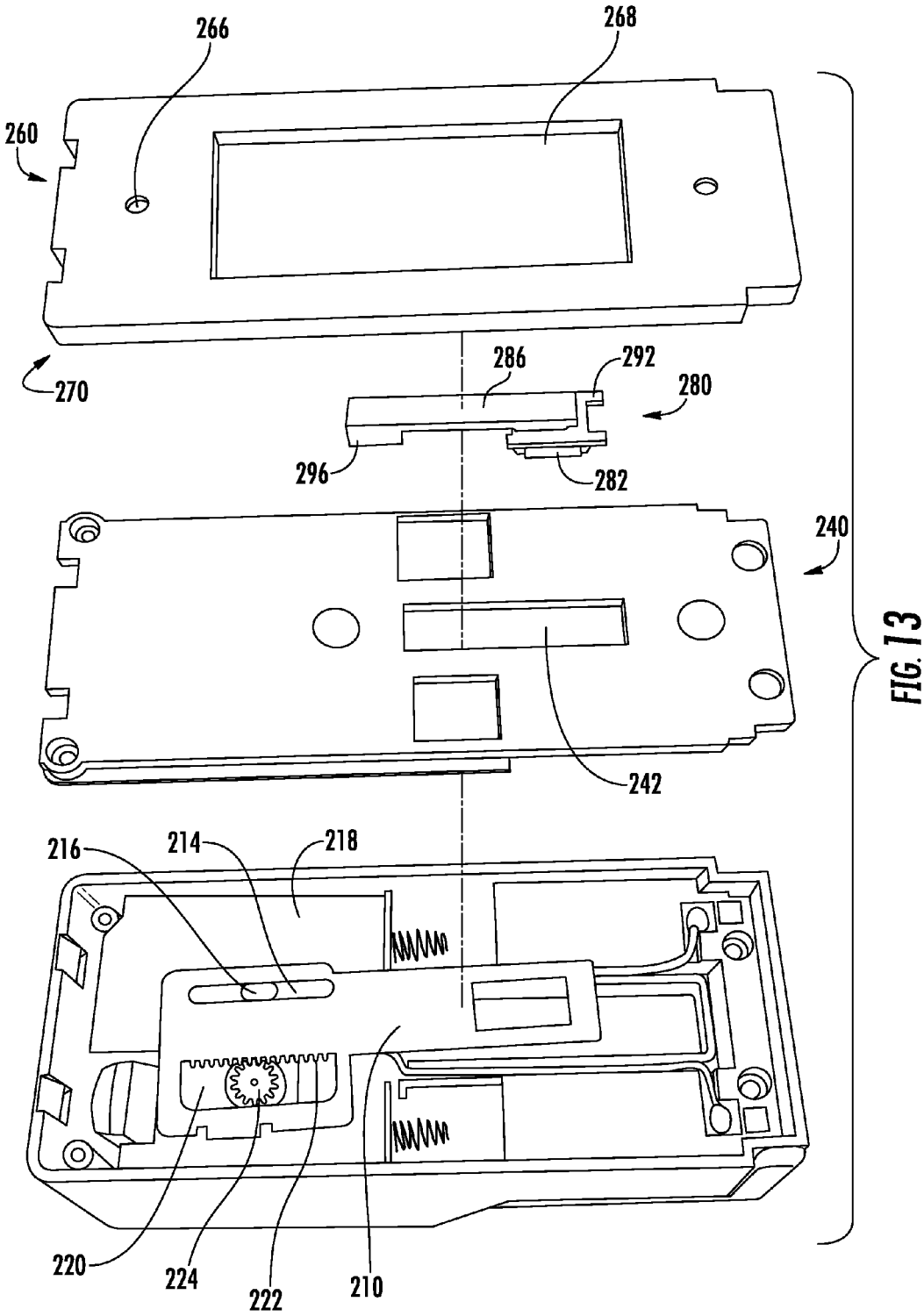
FIG. 13 is an exploded view of the switch timer, decorator switch back plate, clip member, and decorator switch plate with a decorator switch.

FIG. 9 illustrates another embodiment of a clip member 300 of the present invention. The clip member 300 generally includes a base 302 having a fastener or connector 304 extending downward therefrom and a lever arm 306 extending longitudinally from the base 302. The fasteners 304 are shown as comprising a pair of arms 308 having clips 310 on their respective ends for engaging the walls about the slot 212 of the actuator 210. The arms 308 are preferably resistant to allow them to be pushed through the slot 212 and then return back to engage the back wall of the actuator 210 once the clips 310 pass through the slot 212.

A second pair of arms 312 extend from the base proximate the ends of arms 308 and are sized and located to fit within the slot 212 and limit movement of the clip member 300 therein. Walls 314 and 316 located on the outside of arms 312 extend downwardly such that the tops of the walls 314, 316 together with the undersides of the clip 310 define a space for receiving the actuator 210 therein and limiting relative movement of the actuator 210 and clip member 300. Lever arm 306 extends outward from the base 302 a sufficient distance to allow lever arm 306 to engage the surface of the decorator switch 100 to bias it between on and off positions. A block, wall, node or other object 320 may extend upwardly proximate the end of lever arm 306 to provide a contact surface for engaging the decorator switch 100. The clip member 300 may be made out of a variety of known materials, including, but not limited to, polycarbonate or ABS plastic.

In order to use the flip switch timer 200 in connection with a decorator switch 100 and plate 102, the decorator switch back plate 260 is placed over the decorator switch 100 such that the decorator switch 100 fits within hole 268. Once over the decorator switch 100, fasteners 270 may be inserted into holes 266 to secure the decorator switch back plate 260 to the plate 102 or outlet.

Clip member 280 may then be positioned so that arms 288 extend into and through slot 242 on the back wall 240 and slot 212 of the actuator 210 until the clips 290 pass through slot 212 and are biased into engagement with the back side of the actuator 210, securing the clip member 280 to the flip switch timer 200. Similarly, clip member 300 may be positioned so that arms 308 and 312 extend through slot 242 on the back wall 240 and slot 212 of the actuator until the clips 310 press through slot 212 and are biased into engagement with the back ends of the actuator 210, securing the clip member 300 to the flip switch timer 200. Once clip member 280, 300 is in place, the flip switch timer 200 may be positioned over the decorator switch back plate 260 with lever arm 286, 306 positioned within the hole 268 of switch back plate 260, 300 and attached using screws or other fasteners 310. Once installed over the decorator switch 100, the flip switch timer 200 may be programmed using programmable buttons 204 to set up a timer sequence for actuation of the decorator switch 100. When the particular time is reached with the flip switch timer 200, the motor moves the actuator 210, and thereby the clip member 280, 300 that is attached thereto, vertically to engage the raised portion of the decorator switch 100 to move it to the other of the on and off positions.

It will be understood that modifications and variations may be effected without departing from the scope of the novel concepts of the present invention, but it is understood that this application is limited only by the scope of the appended claims.

The invention claimed is:

1. A clip member for use with a flip switch timer for a toggle switch to allow the flip switch timer to be used with a decorator switch having a length, a top side and a bottom side, the clip member comprising:
   - a base;
   - an arm member extending longitudinally from about the base, the arm member being movable longitudinally along the length of the decorator switch to engage the sides of the decorator switch to move the switch between on and off position; and
   - a connector, the connector attaching the clip member to the flip switch timer and comprising a pair of arms having ends and clips on the ends of the arms.

2. The clip member of claim 1 wherein the arm member includes a protruding member extending downwardly therefrom.

3. The clip member of claim 1 wherein the arm member includes a protruding member extending upwardly therefrom.

4. The clip member of claim 1 wherein the clip member is made of polycarbonate.

5. The clip member of claim 1 which further comprises a pair of rail members attached to the base.

6. The clip member of claim 1 wherein the flip switch timer includes a toggle switch actuator having a slot formed therein and wherein the connector attaches to the actuator.

7. A wall mounted flip switch timer having a slot on an actuator that moves longitudinally for directly engaging a toggle switch of an outlet, the improvement comprising:
   - a removable clip member comprising:
     - a base;
     - a connector that attaches the clip member to the slot of the actuator, the connector comprises a pair of arms having ends and clips on the ends of the arms; and
     - an arm member extending from the base, the arm member being movable longitudinally along a decorator switch to engage sides of a the decorator switch to move the switch between on and off positions.

8. The wall mounted flip switch timer of claim 7 wherein the arm member includes a protruding member extending downwardly therefrom.

9. The wall mounted flip switch timer of claim 7 wherein the arm member includes a protruding member extending upwardly therefrom.

10. The wall mounted flip switch timer of claim 7 wherein the clip member is made of polycarbonate.

11. The wall mounted flip switch timer of claim 7 which further comprises a pair of rail members attached to the base.

12. A clip member for use with a flip switch timer for a toggle switch to allow the flip switch timer to be used with a decorator switch having, a top side and a bottom side, the clip member comprising:
   - a base;
   - an arm member extending longitudinally from about the base and including a protruding member extending therefrom to engage the sides of the decorator switch to move the switch between on and off position; and a connector, the connector attaching the clip member to the flip switch timer and comprising a pair of arms having ends and clips on the ends of the arms.

13. The clip member of claim 12 wherein the protruding member extends downwardly therefrom.

14. The clip member of claim 12 wherein the protruding member extends upwardly therefrom.

15. The clip member of claim 12 wherein the clip member further comprises a pair of rail members attached to the base.

* * * * *